US005957273A

United States Patent [19]

Karasik

[11] Patent Number: 5,957,273

[45] Date of Patent: Sep. 28, 1999

[54] UNIVERSAL SWITCH

[75] Inventor: Boris Karasik, Walled Lake, Mich.

[73] Assignee: UT Automotive Dearborn, Inc., Dearborn, Mich.

[21] Appl. No.: 08/898,137

[22] Filed: Jul. 22, 1997

[51] Int. Cl.[6] ..... H01H 23/02

[52] U.S. Cl. ..... 200/556; 200/339

[58] Field of Search ..... 200/556, 553, 200/548, 547, 339, 573, 574, 47

[56] References Cited

U.S. PATENT DOCUMENTS

| | | | |
|---|---|---|---|
| 3,539,738 | 11/1970 | Bowen et al. | 200/47 |
| 3,684,850 | 8/1972 | Kaderbek et al. | 200/556 X |
| 5,207,316 | 5/1993 | Sakamoto | 200/47 |
| 5,446,253 | 8/1995 | Oshgan | 200/556 |
| 5,486,669 | 1/1996 | Oshgan | 200/556 |

FOREIGN PATENT DOCUMENTS

| | | | |
|---|---|---|---|
| 2277199 | 10/1994 | United Kingdom | 200/553 |

*Primary Examiner*—Renee S. Luebke
*Attorney, Agent, or Firm*—Howard & Howard

[57] ABSTRACT

A user-activated switch assembly includes a knob pivotally mounted in a housing. A plunger is selectably mountable in any one of a plurality of locations between the knob and a cam. The cam includes a plurality of cam surfaces, any one of which can be selected based upon the orientation of the cam and/or the location of the plunger.

16 Claims, 2 Drawing Sheets

UNIVERSAL SWITCH

BACKGROUND OF THE INVENTION

The present invention relates generally to a user-activated switch and more particularly to a user-activated switch assembly which can be assembled in different configurations to provide any one of a plurality of switch camming features.

Current switch assemblies generally comprise a rocker knob pivotally mounted to a housing and pivotally moveable, typically among three positions, from a neutral center position to either a rearward position or a forward position. A first set of contacts are closed when the knob is in the forward position and a second set of contacts are closed when the knob is in the rearward position. Typically, one of a plurality of known return features are provided. For example, the knob may be provided with appropriate hardware to provide a spring return from either the forward position or rearward position to the neutral position or to latch the switch in either the forward or rearward position until selectively moved to the other position. Further, combinations of these known return functions can be provided, such that the knob will automatically return from the forward position to the neutral position but latch when moved to the rearward position or vice versa.

In order to provide each of the desired return features, a separate set of hardware is required to be assembled into the switch assembly. This increases tooling costs for the hardware, the amount of inventory which must be maintained, the assembly time required to select, retrieve and install the proper hardware and the overall cost.

SUMMARY OF THE INVENTION

The present invention provides a universal switch assembly which, by being assembled in one of a plurality of configurations, provides one of a plurality of available return features. The switch assembly generally comprises a rocker-type knob, selectably pivotable among a forward position, a neutral position and a rearward position in a housing. A plurality of different cam surfaces each having a different cam profile are provided in the housing. A plunger is mounted between the knob and one of the cam surfaces in the housing. One of the cam surfaces is selected in one of two ways. First, the plunger may be mounted in one of a plurality of locations relative to the knob, such that it is adjacent either the first cam surface or the second cam surface. Second, the cam surfaces may be positioned and oriented in different positions such that the selected one is adjacent the plunger. In this manner, a selected one of a plurality of available cam profiles can be provided to the knob.

Preferably, the plurality of cam surfaces are provided on a cam. A first cam surface is mounted along a first lateral side of the cam, while the second cam surface is mounted along a second lateral side of the cam. The cam can then be mounted in the housing in one of two orientations in order to locate a selected one of either the first cam surface or second cam surface adjacent the plunger.

Most preferably, the cam is also provided with a third cam surface and fourth cam surface on an opposite face of the cam to the first and second cam surfaces, respectively. Thus, any of the cam surfaces can be mounted adjacent the plunger.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
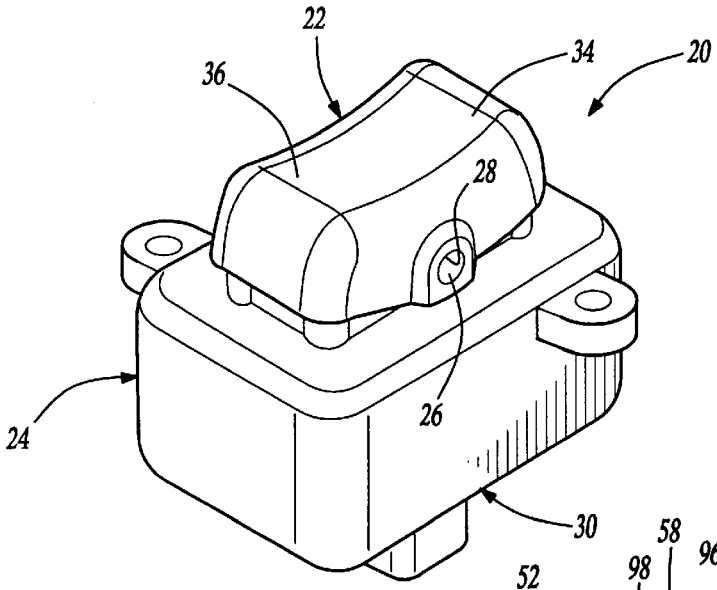
FIG. 1 is a perspective view of the switch assembly of the present invention.

A switch assembly 20 according to the present invention is shown in FIG. 1. A rocker-style knob 22 is pivotally mounted on an upper housing 24. Preferably, pivot pins 26 in the upper housing 24 are snap-fit into apertures 28 in the knob 22 to form a pivot axis. The knob 22 and upper housing 24 are mounted onto a lower housing 30. The knob 22 includes a forward surface 34 forward of the pivot pins 26 and a rearward surface 36 rearwardly of the pivot pins 26 and apertures 28. Typically, a first electrical function is activated when a user presses the forward surface 34, thereby causing the knob 22 to pivot forwardly and a second electrical function is activated when a user presses the rearward surface 36, causing the knob 22 to pivot rearwardly. Of course, the terms "forward" and "rearward" are utilized herein only for convenience. It should be apparent that the switch assembly 20 could be mounted in any orientation.

Figure 2:
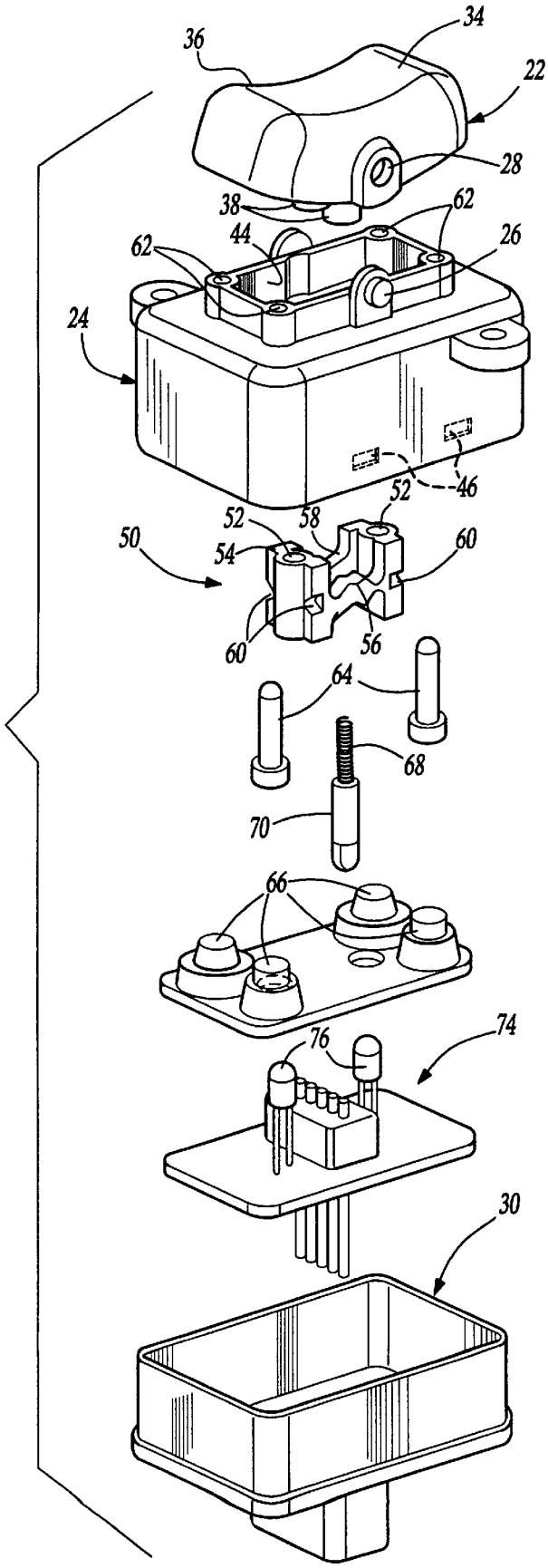
FIG. 2 is an exploded view of the switch assembly of FIG. 1.

An exploded view of the switch assembly 20 is shown in FIG. 2. As can be seen in FIG. 2, the knob 22 includes a pair of laterally spaced cylindrical sleeves 38 extending downwardly, generally perpendicular to the axis defined by the apertures 28. The upper housing 24 includes an upper orifice 44 leading into the upper housing 24. A plurality of tabs 46, preferably four, (two shown) extend inwardly from the housing 30.

The switch assembly further includes a cam 50 having a pair of cylindrical passages 52, one at each axial end. An upper face 54 of the cam 50 includes a first cam surface 56 and a laterally spaced second cam surface 58. A plurality of notches 60 complementary to tabs 46 are disposed about the periphery of the cam 50. Four generally cylindrical passages 62 extend through corners of the upper housing 24.

A plurality of fingers 64 (two shown) such as are typically utilized in rocker-style switches are adapted to engage the knob 22 below the forward surface 34 and the rearward surface 36. Opposite ends of the fingers 64 are adapted to engage elastomeric switch pad 66 which, as is known, each contain a pair of electrical contacts which are opened or closed by pressure on the elastomeric switch pad 66. A spring 68 is provided for biasing a plunger 70 downwardly. The spring 68 and plunger 70 are selected to fit within cylindrical sleeves 38. The switch assembly 20 further includes a PCB assembly 74 from which a pair of LEDs 76 extend upwardly. The passages 62 in the upper housing 24 align with the switch pads 66. The fingers 64 are placed in passages 62 to align with switch pads 66.

Figure 3:
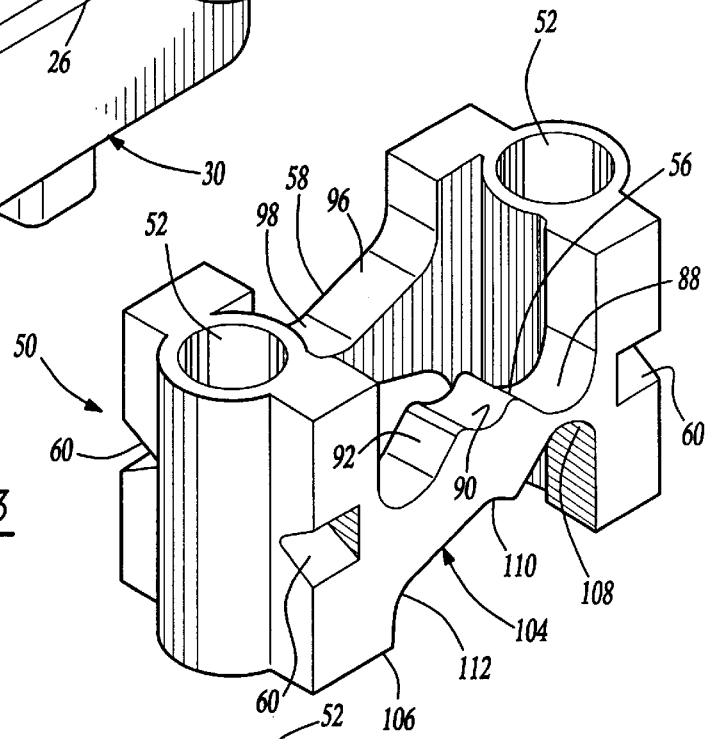
FIG. 3 is a perspective view of the cam of FIG. 2.

FIG. 3 is an enlarged view of the cam 50, showing the upper face 54, which includes the first cam surface 56 and second cam surface 58. It should be apparent that any cam profiles could be utilized in the plurality of cam surfaces provided on cam 50. Those skilled in the art will recognize the operation of the cam profiles illustrated herein and will know of numerous other cam profiles which could also be utilized with the present invention. The cam surfaces on cam 50 will be briefly described only to illustrate how different cam surfaces with different cam profiles can be provided to the knob 22 simply by assembling the components of switch assembly 20 in different configurations. As can be seen in FIG. 3, the first cam surface 56 includes a forward recess 88 which will latch the plunger 70 (not shown) in the forward position. The first cam surface 56 further includes a neutral recess 90 which will retain the knob 22 in the neutral position until the knob 22 is pressed. The first cam surface 56 further includes a rearward recess 92 identical to forward recess 88. The second cam surface 58, on the other hand, is provided with a forward ramp 96, which will always return the plunger 70 from the forward position to the neutral position as soon as pressure on knob 22 is released. Second cam surface 58 further includes a neutral recess 98 retaining knob 22 in the neutral position when no pressure is applied and a rearward ramp 100 identical to forward ramp 96.

Figure 4:
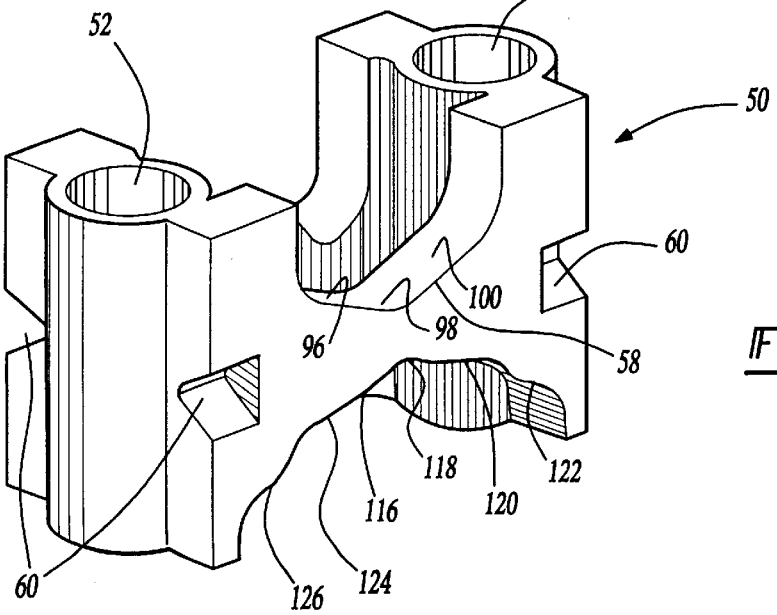
FIG. 4 is a perspective view of the cam of FIG. 3, rotated 180 degrees.

The cam 50 further includes a third cam surface 104 on a lower face 106 opposite upper face 54. The third cam surface 104 provides a combination of the features described with respect to first cam surface 56 and second cam surface 58. Third cam surface 104 includes a forward recess 108 providing a latching feature, and a neutral recess 110. Third cam surface 104 further provides a rearward ramp 112, which will always return the plunger 70 from the rearward position to the neutral position when pressure is released. Again, it should be apparent that the terms "forward" and "rearward" are utilized only with respect to the drawings. It is a feature of the present invention that the cam 50 as shown in FIG. 4 could be rotated about an axis parallel to cylindrical passages 52, such that "forward" and "rearward" would be interchanged. Although first cam surface 56 and second cam surface 58 are symmetrical, this would provide different features with respect to third cam surface 104, which provides different features for the "forward" and "rearward" positions.

The cam 50 is shown in FIG. 4 rotated 180 degrees about an axis parallel to cylindrical passages 52 relative to FIG. 3, in order that a fourth cam surface 116 can be shown. The fourth cam surface 116 provides a cam profile providing a double action profile typically utilized to activate a vehicle window lift function. The fourth cam surface 116 provides a neutral recess 118, from which extends a first forward ramp 120, for activating a window manually, and a second forward ramp 122 for activating a window in express mode. A first rearward ramp 124 extends rearwardly from the neutral recess 118. A second rearward ramp 126 extends rearwardly from first rearward ramp 124.

The assembly steps required to selectively provide a selected cam profile to the knob 22 will be described with respect to FIG. 2. First, the cam 50 can be installed into the upper housing 24 in any one of four orientations. The cam 50 can be installed with the upper face 54 or lower face 106 oriented toward knob 22. Further, for each of these two orientations, the cam 50 can also be rotated about an axis parallel to cylindrical passages 52, thus providing a total of four available orientations in which cam 50 can be installed into upper housing 24. The cam 50 is installed in upper housing 24 by snapping the tabs 46 into the notches 60. Further, the spring 68 and plunger 70 can be located in either of the two laterally spaced cylindrical sleeves 38, such that the plunger 70 will contact either of the two laterally spaced cam surfaces 56, 58 (or 104, 116). In total, this provides a total of eight possible cam profiles which can be provided to the knob 22. However, in the example shown, some of the cam surfaces are symmetrical and therefore, would not provide different cam profiles in some orientations.

Operation of switch assembly 20 will be described assuming the switch assembly 20 is assembled with the cam 50 oriented as shown in FIG. 2 and the spring 68 and plunger 70 located in the knob 22 such that the plunger engages the first cam surface 56. The knob 22 will be provided with a cam profile provided by cam surface 56. As forward surface 34 is pressed, the knob 22 pivots forwardly, thereby causing the plunger 70 to move out of the neutral recess 90 into the rearward recess 92 into which it is latched and causing one of the fingers 64 to depress one of elastomeric switch pads 66 to activate a first electrical function. When the rearward surface 36 of knob 22 is pressed, the knob 22 pivots rearwardly, causing plunger 70 to move out of rearward recess 92 into neutral recess 90. If the rearward surface 36 of knob 22 is further pressed, the knob 22 continues to pivot rearwardly, thereby causing plunger 70 to move out of neutral recess 90 into forward recess 88 and causing one of the fingers 64 to depress one of elastomeric switch pads 66, thereby activating a second electrical function.

It should also be apparent that two springs 68 and plungers 70 could be inserted into both cylindrical sleeves 38 in order to provide multiple cam followers. Multiple elastomeric pads can provide a double pull/double throw switch version.

The switch assembly 20 of the present invention thus provides a possibility of eight cam profiles which can be provided to knob 22 all utilizing the same parts. Simply by selecting the location of spring 68 and plunger 70 in either of the cylindrical sleeves 38 and orienting the cam 50 in one of its four orientations, a selected one of eight possible cam profiles can be provided without the necessity of keeping inventory hardware for each of the eight profiles.

In accordance with the provisions of the patent statutes, the present invention has been described in what is considered to represent a preferred embodiment. However, it should be noted that the invention can be practiced otherwise than as specifically illustrated and described without departing from its spirit or scope.

What is claimed is:

1. A user-activated switch assembly comprising:

a knob selectively moveable between a first extreme position and a second extreme position on a housing;

said housing having a first cam surface having a first cam profile and a second cam surface having a second cam profile different from said first cam profile;

a plunger, said housing and said knob being assembled in either a first configuration or a second configuration, said plunger contacting said first cam surface but not said second cam surface when said knob is moved from said first extreme position to said second extreme position in said first configuration and said plunger contacting said second cam surface but not said first cam surface when said knob is moved from said first extreme position to said second extreme position in said second configuration.

2. The user-activated switch assembly of claim 1 wherein said plunger is mountable adjacent said knob in either a first location or a second location.

3. The user-activated switch assembly of claim 2 wherein said plunger contacts said first cam surface when mounted in said first location and said second cam surface when mounted in said second location.

4. The user-activated switch assembly of claim 1 further comprising:

a cam having said first cam surface and said second cam surface, said cam being mountable into said housing.

5. The user-activated switch assembly of claim 4 wherein said cam is mountable into said housing in at least two different orientations.

6. The user-activated switch assembly of claim 5 wherein said plunger contacts said first cam surface when said cam is mounted in a first orientation and said second cam surface when said cam is mounted in a second orientation.

7. The user-activated switch assembly of claim 5 wherein said cam further includes a third cam surface and a fourth cam surface, said first, second, third and fourth cam surfaces each having a different cam profile.

8. The user-activated switch assembly of claim 7 wherein said cam is mountable into said housing in at least four different orientations.

9. A user-activated switch assembly comprising:

a knob selectively moveable between a first position and a second position;

a housing having a first cam surface having a first cam profile and a second cam surface having a second cam profile different from said first cam profile;

a plunger and said housing being assembled with said plunger biased between said knob and said first cam surface, said plunger moving in contact along said first cam surface while said knob is moved from said first position to said second position, means for mounting said plunger in either a first location in which said plunger engages said first cam surface or a second location in which said plunger engages said second cam surface, said plunger being mounted adjacent said first cam surface.

10. The user-activated switch assembly of claim 9 further including a cam mounted in said housing, said cam including said first cam surface.

11. The user-activated switch assembly of claim 10 wherein said cam further includes said second cam surface, said cam being selectively mountable in said housing in a first orientation such that said first cam surface contacts said plunger or a second orientation such that said second cam surface contacts said plunger.

12. A cam for mounting in a user-activated switch having a cam follower, said cam comprising:

a first cam surface having a first cam profile;

a second cam surface, discontinuous from said first cam surface, said second cam surface having a second cam profile different from said first cam profile;

said cam being mountable in a first orientation to select said first cam surface or a second orientation to select said second cam surface.

13. The cam of claim 12 wherein said first cam surface and said second cam surface are formed on opposite faces of said cam.

14. The cam of claim 12 wherein said first cam surface and said second cam surface are formed generally on a first face of said cam, said first cam surface being laterally spaced from said second cam surface.

15. The cam of claim 12 further including a third cam surface and a fourth cam surface, each of said first, second, third and fourth cam surfaces having a different cam profile.

16. The cam of claim 15 wherein said cam is mountable in any of four orientations, each of said four orientations selecting a different one of said first, second, third and fourth cam surfaces.

* * * * *